US005981449A

United States Patent [19]

Rapisarda et al.

[11] Patent Number: 5,981,449

[45] **Date of Patent: *Nov. 9, 1999**

[54] ACIDIC CLEANING COMPOSITIONS

[75] Inventors: Dario Rapisarda, Rome, Italy; Eddy Vos, Linden, Belgium

[73] Assignee: The Procter & Gamble Company, Cincinnati, Ohio

[ * ] Notice: This patent is subject to a terminal disclaimer.

[21] Appl. No.: 09/011,324

[22] PCT Filed: Aug. 2, 1996

[86] PCT No.: PCT/US96/12685

§ 371 Date: May 6, 1998

§ 102(e) Date: May 6, 1998

[87] PCT Pub. No.: WO97/06228

PCT Pub. Date: Feb. 20, 1997

[30] Foreign Application Priority Data

Aug. 9, 1995 [EP] European Pat. Off. ..... 95870097

[51] Int. Cl.[6] ..... C11D 3/20; C11D 3/34

[52] U.S. Cl. ..... 510/108; 510/220; 510/238; 510/245; 510/247; 510/253; 510/254; 510/362; 510/434; 510/477; 510/488

[58] Field of Search ..... 510/108, 219, 510/220, 238, 245, 247, 253, 254, 269, 362, 406, 426, 434, 477, 488; 134/3, 41, 42

[56] References Cited

U.S. PATENT DOCUMENTS

| | | | |
|---|---|---|---|
| 3,277,008 | 10/1966 | Heit | 252/82 |
| 4,587,030 | 5/1986 | Casey | 510/406 |
| 4,595,519 | 6/1986 | Takend et al. | 510/255 |
| 4,715,980 | 12/1987 | Lopes et al. | 510/234 |
| 4,749,508 | 6/1988 | Cockrell, Jr. et al. | 510/201 |
| 4,877,459 | 10/1989 | Cockrell, Jr. et al. | 134/40 |
| 5,294,364 | 3/1994 | Thomas et al. | 510/238 |
| 5,364,551 | 11/1994 | Lentsch et al. | 510/198 |
| 5,447,575 | 9/1995 | Crump et al. | 134/42 |
| 5,462,697 | 10/1995 | Yianakopoulos | 510/108 |
| 5,554,320 | 9/1996 | Yianakopoulos | 252/389.23 |
| 5,612,308 | 3/1997 | Woo et al. | 510/423 |
| 5,672,578 | 9/1997 | Carrie et al. | 510/245 |
| 5,686,399 | 11/1997 | Bianchetti et al. | 510/191 |
| 5,733,859 | 3/1998 | Carrie et al. | 510/362 |

FOREIGN PATENT DOCUMENTS

| | | |
|---|---|---|
| 0 411 708 | 2/1991 | European Pat. Off. . |
| 0 601 990 | 6/1994 | European Pat. Off. . |
| 0 666 305 | 8/1995 | European Pat. Off. . |
| 0 666 306 | 8/1995 | European Pat. Off. . |
| 57-087476 | 5/1982 | Japan . |
| 62-041295 | 2/1987 | Japan . |

*Primary Examiner*—Lorna M. Douyon
*Attorney, Agent, or Firm*—C. Brant Cook; Kim W. Zerby; Jacobus C. Rasser

[57] ABSTRACT

Aqueous cleaning compositions for removing limescale on hard surfaces comprise maleic acid, an acid which has a first pKa not exceeding 5, and an acid-stable thickener. Compositions comprising maleic acid and alkyl- or aryl-sulphonic acids in combination with thickeners such as xanthan gums are used for removing limescale, for example in large appliances such as automatic dish washers and laundry apparatus.

2 Claims, No Drawings

ACIDIC CLEANING COMPOSITIONS

TECHNICAL FIELD

The present invention relates to aqueous acidic liquid cleaning compositions. More specifically, acidic compositions are described which give optimal performance in removing limescale stains and encrustations while ensuring appropriate surface safety. The compositions herein may be used on a variety of surfaces, ranging from bathrooms, toilets and kitchen surfaces to various appliances like automatic dish washers and washing machines.

BACKGROUND

Tap water contains a certain amount of solubilized ions which upon water evaporation eventually deposit as salts such as calcium carbonate on surfaces which are often in contact with said water, resulting in an anaesthetic aspect of said surfaces. This limescale formation and deposition phenomenon is even more acute in places where water is particularly hard.

It is well known in the art that limescale can be removed chemically with acidic solutions, and a great variety of acidic cleaning compositions have been described for this purpose.

However, in many instances acidic compositions may cause the problem that they present hazards to the surfaces treated therewith. Indeed the acids which are used in acidic compositions, such as phosphoric acid and the like can damage the surfaces being treated. In particular, some corrosion/staining may occur when metal surfaces such as aluminium, chromed steel or stainless steel are treated with such acids.

It is therefore an object of the present invention to obviate this issue in providing a cleaning composition possessing excellent limescale removing capacity while being safe to the surfaces treated therewith.

It is also desirable to formulate a composition particularly suitable to remove limescale in large appliances like automatic dish washers and washing machines. Indeed, limescale deposits in said appliances may build-up on the heater element making heat exchange more difficult. In other words, limescale deposits in said appliances are undesirable not only because they result in an anaesthetic aspect but also as said limescale deposits may result in higher consumption of energy, poorer machine performance and eventually malfunction.

It is thus a further object of the present invention to formulate a cleaning composition suitable to be used for removing limescale in large appliances, said composition possessing excellent limescale removing capacity while being safe to the surfaces treated therewith, especially metal surfaces like heating elements, walls, bottom and any inner part.

It has now been found that the above objects are met by formulating liquid compositions comprising an acid-stable thickener and a specific acidic system, i.e. maleic acid and a second acid which has a first pKa not exceeding 5, or mixtures thereof. Indeed it has been found that the compositions of the present invention comprising maleic acid, said second acid and said acid-stable thickener are significantly safer to the surfaces treated therewith, than the same compositions without said acid-stable thickener, while being also particularly effective in removing limescale. In other words, the use of acid-stable thickeners in an aqueous acidic liquid composition comprising maleic acid and said second acid improves surface safety of the surfaces treated with said composition. Furthermore, it has been found, in the broadest aspect of the present invention, that the use of an acid-stable thickener, in an aqueous acidic liquid composition comprising maleic acid improves limescale removing performance.

An advantage of the aqueous acidic liquid compositions of the present invention particularly suitable for removing limescale in large appliances such as automatic dish washers and/or washing machines is that said compositions provide excellent limescale removal on different types of limescale deposition present in said automatic dish washers and/or washing machines, e.g. on the severe limescale deposits which build up on the warm parts such as the heating element as well as on homogeneous lighter deposits which build up on the extended surfaces like the walls. The aqueous acidic liquid compositions according to the present invention allow to obtain better limescale removing performance at lower total acid level as compared to the powder/granular limescale removal compositions available on the market. Another advantage is that the aqueous acidic liquid compositions according to the present invention allow to prevent tough limescale encrustations build-up that provokes higher energy consumption, less washing effectiveness and possible damages to the machines.

A further advantage of this invention is that said compositions are safe to different hard-surfaces including metal surfaces such as aluminium, chromed steel or stainless steel as well as synthetic materials such as rubber hoses, plastic trays and polymeric connections that are for example found in large appliances.

EP-A-0 496 188 discloses a composition comprising nonionic surfactants together with maleic acid whereby good limescale removal is provided. Although EP-A-0 496 188 discloses thickeners in general as an optional ingredient, no levels are disclosed.

EP-A-601 990 discloses a self thickened acidic composition having a viscosity of 10 cps to 700 cps at 60 rpm shear rate at 20° C. and comprising an organic acid or mixtures thereof, preferably maleic acid and a thickening system comprising from 0.5% to 15% by weight of the total composition of a mixture of a nonionic surfactant and a cationic surfactant. More particularly, EP-A-601 990 discloses compositions which are thickened without the use of a thickener compound.

U.S. Pat. No. 5,232,632 discloses foam liquid hard surface detergent compositions, suitable to be packed in a non-aerosol spray delivery package, comprising a mixture of zwitterionic and nonionic surfactants, a hydrophobic solvent, a polycarboxylate detergent builder and a polymeric shear thinning thickener such as xanthum gum. Preferred compositions have a pH of from 1 to 5.5, however no maleic acid is disclosed.

U.S. Pat. No. 4,891,150 discloses thickened acidic cleansing and descaling compositions. Thickening Is obtained by adding different surfactants or mixtures thereof. Pure thickeners such as xanthum gum are mentioned as not being suitable to be used in the acidic compositions disclosed in U.S. Pat. No. 4,891,150. No maleic acid is disclosed.

GB-A-2 106 927 discloses toilet bowl cleaners which have a pH between 2.2 and 3.5 and comprise a non-volatile water soluble organic acid such as dicarboxylic acids having from 2 to 3 carbon atoms, a detergent and a cellulose ether thickener, preferably methyl hydroxypropyl cellulose at levels of from 0.5% to 1.2% by weight of the total composition. GB 2 106 927 teaches away from the use of maleic acid. Indeed it is mentioned in it that maleic acid was not screened for its solubility because of its inherent toxicity.

WO 95/07957 discloses acidic cleansing compositions for cleaning hard surfaces, said compositions being particularly suitable to be applied thereto by means of spray-type dispensers. Said compositions comprise a strong acid alone or in combination with a weak acid, a surfactant and a thickening amount of an organic polymer thickener such as xanthum gum. Maleic acid and sulphamic acid are mentioned amongst the weak acids and sulphuric acid is mentioned amongst the strong acids. However no levels for the weak organic acids are disclosed in the description and no example discloses maleic acid.

EP-A-411 708 discloses an acidic aqueous liquid composition comprising a detergent, an organic acid having 2 to 10 carbon atoms, an aminoalkylenephosphonic and phosphoric acid. Indeed the addition of an aminoalkylenephosphonic and phosphoric acid on top of mixtures of acids likes succinic, glutaric and adinic acid, improves the safety of the acidic compositions for use on enamel surfaces. The compositions therein are microemulsions which may be thickened by the addition of a thickener such as alkyl cellulose. However the acidic system of the present invention comprising maleic acid at a given level and a second acid which has a first pKa not exceeding 5 is nowhere disclosed in EP-A-411 708.

None of the above mentioned prior art documents discloses the compositions of the present invention whereby improved limescale removal performance and improved safety to the surfaces treated therewith is achieved. Also none of the above mentioned prior art documents discloses the use of a thickened aqueous acidic liquid composition comprising maleic acid and a second acid which has a first pKa not exceeding 5, or mixtures thereof, for removing limescale in large appliances like automatic dish-washers and/or washing machines.

SUMMARY OF THE INVENTION

The present invention is an aqueous acidic liquid cleaning composition suitable for removing limescale deposits from hard-surfaces, having a pH below 2 and comprising from 0.05% to 45% by weight of the total composition of maleic acid, a second acid which has a first pKa not exceeding 5 and from 0.01% to 5% by weight of the total composition of an acid-stable thickener.

The present invention further encompasses a process of treating hard-surfaces, wherein a composition according to the present invention, is applied in its neat form or in a diluted form, onto said surfaces, then left to act onto said surfaces and then removed by rinsing.

The present invention also encompasses the use of a thickened aqueous acidic liquid composition comprising maleic acid and a second acid which has a first pKa not exceeding 5, or mixtures thereof, for removing limescale in automatic dish washers and/or washing machines.

The present invention also encompasses the use of an acid-stable thickener, in an aqueous acidic liquid composition comprising maleic acid and a second acid which has a first pKa not exceeding 5 to improve surface safety of the surfaces treated therewith.

The present invention yet encompasses the use of an acid-stable thickener, in an aqueous acidic liquid composition comprising maleic acid to improve limescale removing performance.

DETAILED DESCRIPTION OF THE INVENTION

The compositions according to the present invention are designed for removing limescale or soils comprising limescale as an essential component. Thus the compositions according to the present invention comprise maleic acid as an essential ingredient. The compositions according to the present invention comprise from 0.01% to 45% by weight of the total composition of maleic acid, preferably from 1% to 25% and more preferably from 6% to 20%. This percentage is calculated on the basis of the molecular weight of the acid form, but maleic anhydride is equally convenient for use in the compositions according to the present invention. Indeed maleic anhydride is generally cheaper and it is transformed into the acid form when incorporated in an aqueous medium.

The compositions of the present invention further comprise as an essential ingredient a second acid which has a first pKa not exceeding 5, or mixtures thereof. Said second acid is desired to strengthen the limescale removal performance. Preferably the second acids to be used herein which are particularly efficient to remove limescale on many surfaces, have their first pKa not exceeding 4, more preferably not exceeding 3, and most preferably not exceeding 2. According to the present invention said acids can be organic or inorganic acids. Examples of inorganic acids are sulphonic acid derivatives, sulphamic acid (pKa=0.1) , hydrochloric acid (pKa<0), nitric acid (pKa<0), phosphoric acid (pKa=2.1) and sulphuric acid (pKa=0.4). An example of organic acid is citric acid (pKa=3.06) . Particularly suitable to be used herein are sulphonic acid derivatives including alkyl sulphonic acids and aryl sulphonic acids.

Suitable alkyl sulphonic acids for use herein are C1–C6 linear or branched alkylsulphonic acids or mixtures thereof, such as methanesulphonic acid (pKa=1.9) commercially available for example from Aldrich, William Blythe & Co. Ltd. or Elf. Atochem.

Suitable aryl sulphonic acids for use herein are according to the formula:

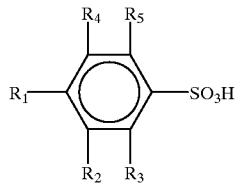

wherein $R_1$, $R_2$, $R_3$, $R_4$ and $R_5$ are each H or $SO_3H$, or linear or branched $C_0$–$C_4$ alkyl chain; or mixtures thereof.

Preferred arylsulphonic acids to be used according to the present invention are those which comprise no or only one alkyl chain. Indeed, we have found that said arylsulphonic acids are particularly effective at removing limescale, which is not the case for their longer alkyl chain homologues. Also we have found that said arylsulphonic acids are particularly safe to the surface treated therewith. Particularly suitable arylsulphonic acids for use herein are benzene sulphonic acid (pKa=0.7), toluene sulphonic acid and cumene sulphonic acid. Amongst these three, at equal weight %, we have found that the shorter the alkyl chain, down to no chain at all, the better the limescale removing performance.

Preferred acids having a first pKa not exceeding 5 to be used herein are sulphamic acid, sulphuric acid, aryl sulphonic acids, alkyl sulphonic acids, or mixtures thereof, more preferred are sulphamic acid, sulphuric acid, benzene sulphonic acid or mixtures thereof and highly preferred is benzene sulphonic acid. Indeed, benzene sulphonic acid is the most preferred acid which has a first pKa not exceeding 5 to be used herein, as it has been found to be significantly safer for the surfaces treated than the other acids which have a first pKa not exceeding 5, whilst maintaining the advantage in limescale removal performance of said acids.

The compositions of the present invention comprise from 0.1% to 20% by weight of the total composition of a second acid which has a first pKa not exceeding 5, or mixtures thereof, preferably from 0.1% to 10% and more preferably from 0.1% to 7%.

The acidic system of the present invention comprising maleic acid and a second acid which has a first pKa not exceeding 5, or mixtures thereof, has been found to provide excellent limescale removal performance and improved surface safety as compared to the same acidic system without maleic acid, this at a given contact time. More particularly the weight ratio of maleic acid to said second acid is such that the surface safety is improved. Accordingly the weight ratio of maleic to said second acid which has a first pKa not exceeding 5, is greater than 3, preferably is from 3 to 50 and more preferably from 3 to 25. Said ratio is dependent on the specific second acid used and thus is different for each second acid or mixtures thereof used.

The compositions according to the present invention further comprise an acid-stable thickener as an essential ingredient. By "acid-stable thickener" it is meant herein any thickener which allows when stored in acidic medium in rapid aging test (RAT) at 50° C. for 10 days that said acidic medium does not loose more than 50% of its initial viscosity and does not separate from said medium.

The acid-stable thickeners to be used herein can be any acid-stable thickener known in the art to thicken liquid compositions and especially aqueous compositions. Acid-stable thickeners are desired in the compositions of the present invention as they allow to formulate thickened compositions at low total thickening compound level, as compared for example to the level of acid-stable thickening surfactant systems which would be required in absence of said acid-stable thickeners to get the same viscosity.

Particularly preferred acid-stable thickeners to be used herein include synthetic thickeners such as polyurethanes or co-polyacrilates or polyacrilamides, polysaccharide thickeners such as substituted cellulose materials or carboxymethylcellulose or hydroxymethylcellulose and naturally occurring thickeners like xanthum gum or derivatives thereof, or mixtures thereof.

Particularly suitable acid-stable thickeners to be used herein are polysaccharide thickeners such as xanthum gum and derivatives thereof. Xanthum gum and derivatives thereof may be commercially available for instance from Kelco under the trade name Keltrol RD®, Kelzan S® or Kelzan T®.

Xanthum gum or derivatives thereof are preferred to be used herein as they are physically and chemically stable in the acidic conditions of the compositions of the present invention, this even at pH below 1.5. Also the acidic liquid compositions of the present invention are chemically stable, i.e. there is virtually no chemical changes of the different ingredients due to reaction between different ingredients, and physically stable, i.e. that no phase separation occurs when stored in rapid aging test (RAT) at 50 ° C. for 10 days.

The compositions according to the present invention comprise from 0.05% to 5% by weight of the total composition of an acid-stable thickener, or mixtures thereof, preferably from 0.05% to 1% by weight, more preferably from 0.05% to 0.86% and most preferably from 0.1% to 0.7%.

Accordingly, the compositions according to the present invention have a viscosity of from 30 cps to 1500 cps at 20° C., preferably of from 40 cps to 800 cps and more preferably of from 100 cps to 600 cps, when measured with a Carri-med rheometer CLS 100 at 7.5 rpm.

It has now been found that the compositions of the present invention comprising maleic acid, a second acid which has a first pKa not exceeding 5 and an acid-stable thickener exhibit improved surface safety to the surface treated therewith as compared to the same compositions without any acid-stable thickener. This surface safety benefit is even more noticeable when the second acid which has a first pKa not exceeding 5 is present at high levels, e.g., more than 3% by weight of the total composition. Thus an aspect of the present invention is the use of an acid-stable thickener, in an aqueous acidic liquid composition comprising maleic acid and a second acid which has a first pKa not exceeding 5 to improve surface safety of the surfaces treated therewith.

By "surface safety improvement" it is to be understood that less damage to the surface treated is observed with the compositions of the present invention compared to the same compositions without any acid-stable thickener, this at a given time of contact. A method suitable for measuring surface safety is a visual grading method mentioned hereinafter in the examples.

It has also been observed that the compositions of the present invention comprising maleic acid, a second acid which has a first pKa not exceeding 5 and an acid-stable thickener exhibit improved limescale removal properties as compared to the same compositions but without such acid-stable thickener, this when applied neat onto the surfaces treated, i.e. per se in a liquid form, and especially when applied in the form of a spray. It has further been observed that the addition of an acid-stable thickener, or mixtures thereof, improves limescale removal performance of an aqueous acidic liquid composition, even in the absence of said second acid. Thus another aspect of the present invention is the use of an acid-stable thickener, in an aqueous acidic liquid composition comprising maleic acid to improve limescale removing performance.

Improved limescale removing performance has been observed for different types of limescale stains, including the kitchen-type stains and the bathroom-type stains, i.e. for stains which contain not only calcium carbonate but also soap scum and/or grease. Also excellent limescale performance has been observed when used under diluted conditions. Accordingly the compositions of the present invention are particularly suitable for removing limescale in large appliances like automatic dish washers and/or washing machines.

A further advantage with a composition according to the present invention suitable to be used for removing limescale in an automatic washer and/or washing machine is that when dispensed onto the interior walls of said washer/machine the drainage of said composition to the bottom of said washer/machine is slowed down, thereby avoiding that said composition is evacuated from the interior of said washer/machine before the washing cycle starts, or stays in dead corners of said washer/machine during the washing cycle (e.g., parts of a washing machine that are not involved in the washing process like the drainage hose before the pump in washing machines). Accordingly the compositions of the present invention when used for descaling large appliances allow a further descaling action during the washing cycle and very simple usage instructions, without the need to open the washer/machine after the cycle has started and without the need of a specifically designed package execution for controlled/delayed delivering of the composition. Indeed, the composition is applied neat directly on the interior surfaces of said washer/machine where it starts its descaling action and continues said descaling action during the washing cycle before being finally removed by rinsing which occurs at the end of the washing cycle.

The compositions according to the present invention have a pH below 2, preferably of from 0 to 1.5 and more preferably of from 0.3 to 1.

The compositions according to the present invention may further comprise optional ingredients such as a surfactant or mixtures thereof. Preferably the compositions according to the present invention comprise up to 30% by weight of the total composition of said surfactant or mixtures thereof, more preferably from 0.05% to 10%, more preferably from 0.1% to 8% and most preferably from 0.1% to 3%. All types of surfactants may be used in the present invention including nonionic, anionic, cationic, amphoteric or zwitterionic surfactants. It is also possible to use mixtures of such surfactants without departing from the spirit of the present invention.

Suitable nonionic surfactants to be used herein are alkoxylated alcohol nonionic surfactants which can be readily made by condensation processes which are well known in the art. However, a great variety of such alkoxylated alcohols, especially ethoxylated and/or propoxylated alcohols is also conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, E is ethylene oxide and P is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol$^R$ or from Shell under the trade name Lutensol$^R$. These nonionics are preferred because they have been found to allow the formulation of a stable product without requiring the addition of stabilisers or hydrotopes. When using other nonionics, it may be necessary to add hydrotopes such as cumene sulphonate or solvents such as butyldiglycolether.

Suitable anionic surfactants for use herein are according to the formula $R_1SO_3M$ wherein $R_1$ represents a hydrocarbon group selected from the group consisting of straight or branched alkyl radicals containing from 6 to 24 carbon atoms and alkyl phenyl radicals containing from 6 to 15 carbon atoms in the alkyl group. M is a salt forming cation which typically is selected from the group consisting of sodium, potassium, ammonium, and mixtures thereof.

Other suitable anionic surfactants can be represented by the water-soluble salts of an alkyl sulfate or an alkyl polyethoxylate ether sulfate wherein the alkyl group contains from 6 to 24 carbon atoms, and preferably from 1 to 30 ethoxy groups for the alkyl polyethoxylate ether sulfates.

Suitable cationic surfactants to be used herein include derivatives of quaternary ammonium, phosphonium, imidazolium and sulfonium compounds. Preferred cationic surfactants for use herein are according to the formula $R_1R_2R_3R_4N^+ X^-$, wherein X is a counteranion, $R_1$ is a $C_8$–$C_{20}$ hydrocarbon chain and $R_2$, $R_3$ and $R_4$ are independently selected from H or $C_1$–$C_4$ hydrocarbon chains. In a preferred embodiment of the present invention, $R_1$ is a $C_{12}$–$C_{18}$ hydrocarbon chain, most preferably $C_{14}$, $C_{16}$ or $C_{18}$, and $R_2$, $R_3$ and $R_4$ are all three methyl, and X is halogen, preferably bromide or chloride, most preferably bromide. Examples of cationic surfactants are stearyl trimethyl ammonium bromide (STAB), cetyl trimethyl ammonium bromide (CTAB) and myristyl trimethyl ammonium bromide (MTAB).

Suitable zwitterionic surfactants contain both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used. A generic formula for some preferred zwitterionic surfactants is $$R_1—N^+(R_2)(R_3)R_4X^-$$

wherein $R_1$ is a hydrophobic group; $R_2$ and $R_3$ are each $C_1$–$C_4$ alkyl, hydroxy alkyl or other substituted alkyl group which can also be joined to form ring structures with the N; $R_4$ is a moiety joining the cationic nitrogen atom to the hydrophilic group and is typically an alkylene, hydroxy alkylene, or polyalkoxy group containing from 1 to 4 carbon atoms; and X is the hydrophilic group which is preferably a carboxylate or sulfonate group. Preferred hydrophobic groups $R_1$ are alkyl groups containing from 8 to 22, preferably less than 18, more preferably less than 16 carbon atoms. The hydrophobic group can contain unsaturation and/or substituents and/or linking groups such as aryl groups, amido groups, ester groups and the like. In general, the simple alkyl groups are preferred for cost and stability reasons.

Other specific zwitterionic surfactants have the generic formulas:

$$R_1—C(O)—N(R_2)—(C(R_3)_2)_n—N(R_2)_2^{(+)}—(C(R_3)_2)_n—SO_3^{(-)}$$

or $$R_1—C(O)—N(R_2)—(C(R_3)_2)_n—N(R_2)_2^{(+)}—(C(R_3)_2)_n—COO^{(-)}$$

wherein each $R_1$ is a hydrocarbon, e.g. an alkyl group containing from 8 up to 20, preferably up to 18, more preferably up to 16 carbon atoms, each $R_2$ is either a hydrogen (when attached to the amido nitrogen), short chain alkyl or substituted alkyl containing from one to 4 carbon atoms, preferably groups selected from the group consisting of methyl, ethyl, propyl, hydroxy substituted ethyl or propyl and mixtures thereof, preferably methyl, each $R_3$ is selected from the group consisting of hydrogen and hydroxy groups and each n is a number from 1 to 4, preferably from 2 to 3, more preferably 3, with no more than one hydroxy group in any $(C(R_3)_2)$ moiety. The $R_1$ groups can be branched and/or unsaturated. The $R_2$ groups can also be connected to form ring structures. A surfactant of this type is a $C_{10}$–$C_{14}$ fatty acylamidopropylene(hydroxypropylene)sulfobetaine that is available from the Sherex Company under the trade name "Varion CAS sulfobetaine"®.

Suitable amphoteric surfactants are surfactants which are similar to the zwitterionic surfactants but without the quaternary group. However, they contain an amine group that is protonated at the low pH of the composition to form cationic group and they may also possess an anionic group at these pHs.

The compositions according to the present invention are aqueous. Accordingly, the compositions according to the present invention comprise from 10% to 95% by weight of the total composition of water, preferably from 506 to 90%, most preferably from 70% to 85%.

The compositions according to the present invention may further comprise a variety of other ingredients including perfumes, colorants, bactericide, dyes, chelants, pigments, solvents, stabilizers, corrosion inhibitors and the like.

The compositions according to the present invention are particularly suitable for treating hard-surfaces including metal surfaces which can be found in a kitchen or in a bathroom. Indeed, the compositions of the present invention exhibit good limescale removing properties for both the kitchen-type stains and the bathroom-type stains, i.e. for stains which contain not only calcium carbonate but also soap scum and/or grease.

Accordingly, the present invention encompasses a process of treating hard-surfaces wherein an aqueous acidic liquid composition according to the present invention is applied in its neat form or in diluted form, onto said surfaces, then left to act onto said surfaces and then removed by rinsing. Said process can be used both for treating metal surfaces found in bathrooms, kitchens or appliances.

The expression "used in diluted form" herein includes dilution by the user. Typical dilution levels are of from 0.5% to 50% by weight of the composition.

The expression "treating" includes removing limescale deposits while being safe to the surfaces treated as well as washing when the compositions according to the present invention further comprise surfactants.

The compositions according to the present invention are also particularly suitable for treating hard-surfaces including metal surfaces which can be found in large appliances such as automatic dish washers and/or washing machines. It has now been found that thickened aqueous acidic liquid compositions comprising maleic acid and a second acid which has a first pKa not exceeding 5 are particularly suitable for descaling large appliances. Thus a broader aspect of the present invention is the use of thickened aqueous acidic liquid compositions comprising maleic acid and a second acid which has a first pKa not exceeding 5 for removing limescale in automatic dish washers and/or washing machines. Said thickened compositions have a viscosity as already defined herein before.

The performance and rheological behaviour of said thickened compositions are adapted to the dishwasher and washing machine cycle and allow maximum performance with an usage procedure that does not impact on consumer habits (e.g. no need to open the machine after the washing cycle has started) and without the need of specifically designed package execution for delayed controlled release of the compositions. Indeed said thickened compositions may be applied directly on the limescale deposits present in the dishwasher and/or washing machine, thereby performing their action before the washing cycle and during said washing cycle once said dishwasher and/or washing machine has been switched on.

Accordingly the present invention further encompasses a process for removing limescale in a large appliance like an automatic dish washer and/or a washing machine, wherein a thickened aqueous acidic liquid composition comprising maleic acid and a second acid which has a first pKa not exceeding 5, or mixtures thereof, is dispensed onto the surfaces to be treated in its neat form, then left to act onto said surfaces, preferably during 2 minutes to 20 minutes and more preferably during 5 minutes to 10 minutes, before said appliance (washer/machine) is switched on. In this latter stage said washer and/or machine undergoes a washing cycle which allow to complete the descaling action and finally removes said composition by rinsing.

By "to switch on" it is to understood herein that said washer and/or machine undergoes a washing cycle without prewash. It is to understood also that said washing cycle is conducted without the addition of any detergent and in so called empty conditions, i.e. without charge (free of clothes or free of dishes).

The compositions to be used in the application of treating large appliances preferably contain low levels of surfactants if present, preferably below 1 by weight of the total composition and more preferably from 0.1% to 0.9%. In the application of treating large appliances it is preferred to use the cationic surfactants described hereinbefore as the surfactant, if surfactants are present.

The compositions according to the present invention have been found to provide excellent limescale removal performance under usage conditions of large appliances, i.e. said compositions can be used diluted and in hot conditions (up to 90°C.).

The compositions according to the present invention are also particularly suitable to be applied to the surfaces to be treated by means of a spray-type dispenser while being safe both to the user and to the surfaces treated therewith. Accordingly the compositions according to the present invention are easy to handle in a safe way. Indeed, the addition of an acid-stable thickener such as xanthum gum which is a shear thinning thickener in an acidic aqueous liquid composition also allows to prevent the inhalation by the user of said acidic composition when sprayed via spray-type dispenser and thus avoid any potential health issue due to the presence of acids in said acidic liquid composition. Thus another aspect of the present invention is an acidic composition packaged in a spray-type dispenser, said acidic liquid composition comprising from 0.01% to 45% by weight of the total composition of maleic acid, a second acid which has a first pKa not exceeding 5, and an acid-stable shear thinning thickener.

Another advantage of the present invention is that the acidic liquid cleaning compositions of the present invention comprising an acid-stable thickener such as xanthum gum which is a shear thinning thickener may be easily dispensed onto the surface to be treated via a spray-type dispenser such as for instance a trigger-sprayer. Indeed, said compositions result in a shear thinning behaviour for ease of dispensing, i.e. said compositions are thinner at higher shear rates. Thus said compositions pass easily through the pumping mechanism of a spray-type dispenser where the shear rate is high and immediately after recover their thickened character when reaching the surface to be treated and adhere thereto. Also, the life time of a spray-type dispenser head is extended, i.e. the shear thinning behaviour of said compositions prevents clogging of said head.

Suitable spray-type dispensers to be used according to the present invention include manually operated foam trigger-type dispensers sold for example by Specialty Packaging Products, Inc. or Continental Sprayers, Inc.

These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northen Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

A further advantage of the present invention is that the acidic liquid cleaning compositions of the present invention may be applied uniformly to a relatively large area of a surface to be treated via a spray-type dispenser, thereby ensuring improved cleaning performance, especially on encrustated soils.

Yet another advantage of the present invention is that also eye irritation and/or damage is prevented when spraying an acidic liquid cleaning composition according to the present invention.

The present invention is further illustrated by the following experimental data and examples.

| | Compositions | | | | |
|---|---|---|---|---|---|
| | I | II | III | IV | V |
| Maleic acid | 16 | 16 | 18 | 16 | 18 |
| Benzenesulphonic acid | 2 | — | — | — | — |
| Sulphamic acid | — | 2 | — | 2 | — |
| Kelzan T ® | 0.3 | 0.3 | 0.3 | — | — |
| Water and minors | - - - - - - -up to 100%- - - - - - - | | | | |
| Viscosity (cps) at 7.5 1/sec | 180 | 180 | 180 | <10 | <10 |
| Surface safety | B | B | — | Ref. | — |
| limescale removal performance | B | B | B | Ref. | W |

Compositions I and II are representative of the compositions of the present invention they comprise maleic acid, a second acid which has a first pKa not exceeding 5 and an acid-stable thickener, i.e. xanthum gum commercially available from KELCO. Composition III is also representative of the present invention and comprises maleic acid as the acid and an acid stable thickener. Composition IV comprises maleic acid, a second acid which has a first pKa not exceeding 5 and is free of an acid-stable thickener. Composition V comprises maleic acid and is free of an acid-stable thickener.

The Following Test were Carried Out:

The Surface Safety Test:

The surface safety test method was conducted on an aluminium surface. Similar aluminium bars were dipped into the tested compositions I, II and IV and left soak for 4 hours at room temperature (25°). At the end of the exposure time, the surfaces were rinsed with soft water and wiped dry. The comparison between the surfaces treated with the different compositions mentioned herein before was done visually. The surface treated with Composition IV was taken as a reference and compared to the surfaces treated with compositions I and II.

B (better)=less surface damage as compared to reference.

Limescale Removing Test:

The limescale removal tests have been conducted measuring the weight loss of a marble block (6+/−0.2 gr.). Compositions I, II, III and V were compared to composition IV, taken as a reference. B (better) stands for more weight loss of the marble block as compared to the reference. W (worse) stands for less weight loss of the marble block as compared to the reference.

3 ml. of each of the compositions I to V was applied with a pipette on blocks put on a 90° (i.e. vertical) plan and left act for 10 minutes. After this the compositions were rinsed and the process was repeated three times.

The above results show that the compositions of the present invention when used to treat hard-surfaces such as metal surfaces exhibit improved surface safety to the surfaces treated therewith as well as improved limescale removal performance (see compositions I and II versus IV). Accordingly the compositions of the present invention have been found to be particularly suitable for cleaning large appliances like automatic dish washers and/or washing machines. The above results also demonstrate that the use of an acid-stable thickener in an acidic composition comprising maleic acid alone or in combination with a second acid improves the limescale removal performance of said composition (see composition II versus composition IV and composition III versus composition V).

2) EXAMPLES

Further examples of compositions according to the present invention are the following. These compositions are made comprising the listed ingredients in the listed proportions (weight %)

| Ingredients: | Compositions | | | | | |
|---|---|---|---|---|---|---|
| (% by weight) | 1 | 2 | 3 | 4 | 5 | 6 |
| Maleic acid | 16 | 8 | 20 | 16 | 16 | 14 |
| Benzenesulphonic acid | 2 | 2 | 2 | 2 | / | 2 |
| Sulphamic acid | 1 | / | / | 1 | / | 1 |
| Sulphuric acid | / | / | / | / | 2 | / |
| Xanthum gum | 0.3 | 0.5 | 0.8 | 0.6 | 0.3 | 0.3 |
| Waters & Minors | - - - - - - -up to 100- - - - - - | | | | | |
| Viscosity (cps) at 7.5 1/sec | 180 | 320 | 950 | 480 | 180 | 180 |

Compositions 1 to 6 were found to provide excellent limescale removal performance as well as excellent surface safety to the surfaces treated therewith. Furthermore, said compositions were found to be particularly suitable for descaling large appliances like automatic dish washers and washing machines. Finally when applied on the surfaces to be treated via a spray-type dispenser said compositions are safe to the user, i.e. they prevent inhalation by the user of acidic droplets.

What is claimed is:

1. An aqueous acidic liquid cleaning composition having a pH below 2, suitable for removing limescale deposits from hard-surfaces, comprising from 0.01% to 45% by weight of the total composition of maleic acid, a second acid which has a first pKa not exceeding 5 and which is a member selected from the group consisting of alkyl sulphonic acids wherein the alkyl chain is a $C_1$ to $C_6$ linear or branched alkyl chain, aryl sulphonic acids according to the following formula:

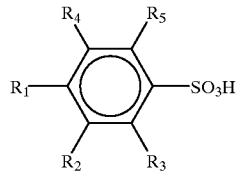

wherein $R_1$, $R_2$, $R_3$, $R_4$ and $R_5$ are each H or $SO_3H$, or linear or branched alkyl chain having up to 4 carbon atoms; or mixtures of said second acid, and from 0.05% to 5% by weight of the total composition of an acid-stable thickener.

2. A composition according to claim 1 wherein said second acid is benzene sulphonic acid.

* * * * *

UNITED STATES PATENT AND TRADEMARK OFFICE
CERTIFICATE OF CORRECTION

PATENT NO. : 5,981,449

DATED : November 9, 1999

INVENTOR(S) : D. Rapisarda et al..

It is certified that error appears in the above-identified patent and that said Letters Patent is hereby corrected as shown below:

In Col. 2, line 54, "Is" should read --is--.

In Col. 3, line 17, "adinic" should read --adipic--.

In Col. 5, line 62, "0.86%" should read --0.8%--.

In Col. 9, line 1, "506" should read --50%--.

In Col. 10, line 9, "1" should read --1%--.

In Col. 11, line 19, please insert

--1) Experimental data

The following compositions were made by mixing the listed ingredients in the listed proportions (weight % unless otherwise specified).--.

Signed and Sealed this

Twenty-seventh Day of February, 2001

Nicholas P. Godici

*Attest:*

NICHOLAS P. GODICI

*Attesting Officer*

*Acting Director of the United States Patent and Trademark Office*